United States Patent [19]

Henshaw

[11] 4,283,815

[45] Aug. 18, 1981

[54] BUTTON CONSTRUCTION

[76] Inventor: Brian H. Henshaw, 2719 Robinson St., Regina, Saskatchewan, Canada

[21] Appl. No.: 2,374

[22] Filed: Jan. 10, 1979

[30] Foreign Application Priority Data

Jun. 9, 1978 [CA] Canada ..... 305151

[51] Int. Cl.[3] ..... A44B 1/18

[52] U.S. Cl. ..... 24/90 A; 24/90 C; 24/104

[58] Field of Search ..... 24/90 A, 90 B, 90 C, 24/90 E, 92, 103, 104, 108, 113 MP

[56] References Cited

U.S. PATENT DOCUMENTS

| | | | |
|---|---|---|---|
| 2,586,904 | 2/1952 | Baritz | 24/92 |
| 3,771,199 | 11/1973 | Eldringhoff | 24/90 B X |
| 3,785,010 | 1/1974 | Owen | 24/90 E |
| 4,097,969 | 7/1978 | Nysten | 24/103 X |

FOREIGN PATENT DOCUMENTS

| | | | |
|---|---|---|---|
| 92075 | 8/1922 | Austria | 24/92 |
| 408824 | 1/1945 | Italy | 24/92 |

*Primary Examiner*—William H. Schultz
*Attorney, Agent, or Firm*—Stanley G. Ade

[57] ABSTRACT

Conventionally, buttons for covering with fabric consist of a hollow back portion with a stem or the like extending therefrom and a front shell snapped into place over the edge of the back portion with fabric covering the front shell and being clamped between the front shell and the back portion. This front portion often disengages from the back portion and sometimes the fabric is cut and damaged by the sharp edges of the mating portions. Also, the attaching stem often disengages from the back shell as it is not usually integrally formed therewith. One embodiment of the present device utilizes a combination front shell and stem having an inturned peripheral lower edge. An apertured disc engages over the stem and snaps into position with the interior lower edge thus holding the fabric firmly and substantially reducing the possibility of disengagement. The preferred embodiment consists of a separate stem which snap engages into an apertured front shell and the apertured disc then snaps into position as in the first embodiment.

9 Claims, 11 Drawing Figures

BUTTON CONSTRUCTION

BACKGROUND OF THE INVENTION

This invention relates to new and useful improvements in button construction, particularly buttons which are adapted to be covered with fabric or the like for use in dressmaking, upholstery finishing and the like.

Conventionally, such buttons may comprise a hollow back shell with a stem detachably secured thereto. A hollow front shell snaps over the rim of the back shell and clamps the fabric, covering the front shell, between the two portions. Firstly, the sharp edges of the two mating portions often cut or fray the material and secondly, the fit of the two portions does not permit much variation in the thickness of fabric that can be used to cover the front shell. Consequently, the two shell portions are easily disengaged one from the other.

SUMMARY OF THE INVENTION

The present invention overcomes these disadvantages by providing, in one embodiment, an integrally formed front portion and stem with a locking disc over the stem and snap engaging within the head portion and one aspect of the invention consists of a button construction for dressmaking, upholstering use and the like, adapted to be covered with flexible material such as fabrics and the like; comprising in combination an integrally formed button head and attaching stem, and an apertured locking disc engaging over said attaching stem and means to fixedly engage said locking disc with said head internally thereof, to hold in place, the associated flexible material covering said head.

The preferred embodiment consists of a separate button head and stem with the stem snap engaging into the apertured button head.

Another advantage of the present invention is that fabrics of various thicknesses can be held in place by the locking disc without any danger of cutting or fraying of the fabric.

Another advantage of the present invention is to provide a device of the character herewithin described which is simple in construction, economical in manufacture and otherwise well suited to the purpose for which it is designed.

With the foregoing in view, and other advantages as will become apparent to those skilled in the art to which this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
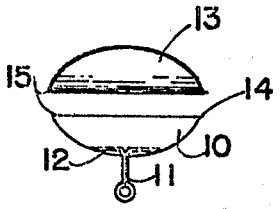
PRIOR ART FIG. 1
FIG. 1 is a side elevation of a conventional button construction shown with the two shell portions slightly apart from one another.

Proceeding therefore to describe the invention in detail, reference should first be made to FIG. 1 which shows a conventional type button adapted to be covered by material or the like.

It consists of a hollow base shell 10 having a stem 11 engaging through an aperture within the shell 10 and having end 12 spread apart to hold the stem in position.

A hollow upper shell 13 is also provided and it normally snaps over the peripheral edge 14 of the lower shell 10 planting fabric (not illustrated) therebetween and it is the sharp edges 15 of the shell portion which tend to cut or fray fabrics clamped therebetween. It will also be observed that bacause of the design of this conventional type of button, only relatively thin fabrics can be clamped between the portions without the danger of the upper shell 13 becoming disengaged from the lower shell.

Figure 2:
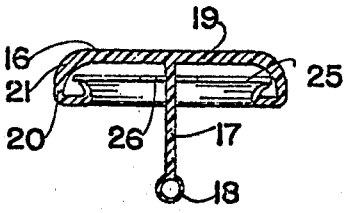
FIG. 2 is a cross sectional view of one embodiment of the improved button.
Figure 3:
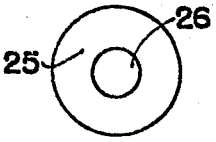
FIG. 3 is a plan view of the locking disc per se.
Figure 4:
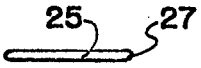
FIG. 4 is a side elevation of FIG. 3.
Figure 5:
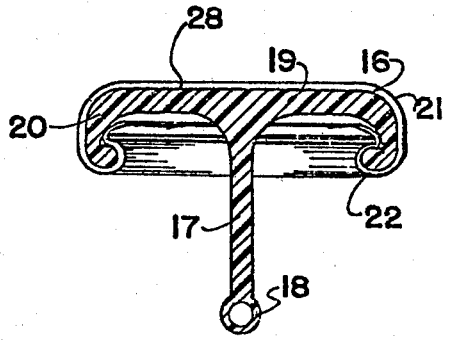
FIG. 5 is an enlarged view similar to FIG. 2, but with the locking disc in place and fabric engaged over the head and locked into position.

The present invention is illustrated in FIGS. 2 through 7 and dealing first with FIG. 2, the invention comprises a moulded head or upper portion 16, together with a stem 17 moulded integrally therewith. In FIG. 2, the stem extends perpendicularly from the head 16 and centrally thereof and terminates with a closed loop of eye 18 at the distal end of the stem. The head 16 consists of the substantially circular upper or main portion 19 with an annular wall 20 extending from the outer edge area 21 of the central portion 19 and this annular wall is provided with an inturned lip 22 at the lower edge thereof with reference to FIG. 2. This lip is turned inwardly and curls upwardly and slightly outwardly as clearly shown in FIGS. 2 and 5. The assembly comprising the head 16 and stem 17 are preferably injection moulded from synthetic plastic, but of course can be made from other materials if desired.

Figure 6:
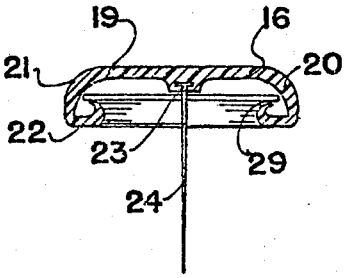
FIG. 6 is a view similar to FIG. 2, but showing an alternative embodiment.
Figure 7:
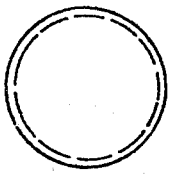
FIG. 7 is a top plan view of FIGS. 2 and 6.
Figure 11:
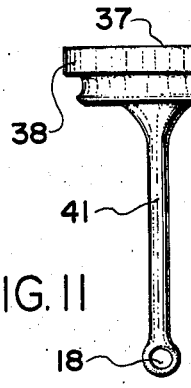
FIG. 11 is a view similar to FIG. 8 but showing an alternative embodiment.

An alternative construction shown in FIG. 6 is particularly suited for use with upholstery finishing. In this embodiment, the head 16 is provided with a centrally located boss 23 on the inner surface thereof with a nail or tack 24 embedded therein and moulded integrally during the formation of the head. The remainder of the construction of the head is similar to that described in FIG. 2.

In both embodiments, a locking disc 25 is provided. This is a circular, centrally apertured disc with the aperture being identified by reference character 26. It also is preferably made from plastic but can be made from metal, depending upon design and outer periphery 27 of this locking disc is provided with a rounded configuration as illustrated clearly in FIG. 4.

It is adapted to engage over the stem 17 or nail 24 and to be distorted as it is snap engaged within the inturned lip portion 22. The plastic is such that it returns to its original shape once this distortion has taken place in order to force it into position.

It will therefore be seen that a layer of fabric 28 can be engaged over the head and peripheral wall of the portion 16 whereupon the locking disc 25 is engaged over the stem 17 or nail 24 and snap engaged into position. The clearance provided within the interior of the head enables fabrics of varying thicknesses to be used, within limits, and to be held firmly in position by means of locking disc and without any danger of cutting or fraying the fabric due to the rounded periphery 27 of the locking disc and due to the rounded periphery 29 of the inturned lip 22.

Figure 8:
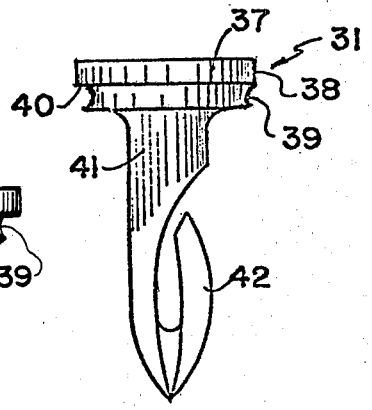
FIG. 8 is a side elevation of the stem of the preferred embodiment.
Figure 9:
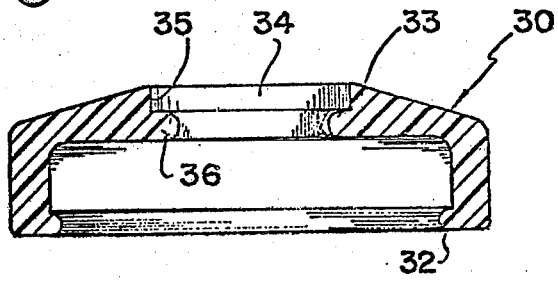
FIG. 9 is a cross sectional view of the button head of the preferred embodiment.
Figure 10:
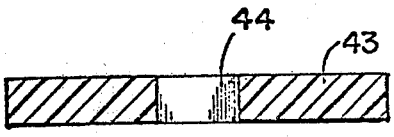
FIG. 10 is a cross sectional view of the disc similar to that shown in FIG. 3, but with the thickness thereof exaggerated for clarity.

The preferred embodiment is shown in FIGS. 8, 9 and 10 in which the button head collectively designated 30 is formed separately from the stem collectively designated 31.

The head in this embodiment, is also preferably formed from synthetic plastic and is provided with the inturned lip portion 32 as previously described. However, the upper or central portion 33 of the head is apertured as at 34, said aperture being circular and having an enlarged outer diameter defined by the cylindrical wall 35 and a smaller inner diameter defined by the circular wall 36. The circular wall 36 is curved inwardly as shown.

The stem 31 includes a head 37 which is cylindrical when viewed in plan and includes the enlarged outer cylindrical portion 38 and a smaller or inner cylindrical portion 39 separated by the step shoulder configuration 40. The stem 41 extends from the center of the smaller diameter portion 39 and may terminate with a loop 18 similar to that shown in FIGS. 2 and 3, a nail 24 as shown in FIG. 6, or a hooked end 42 as shown in FIG. 8. This hooked end 42 is formed integrally when the stem portion is injection moulded or otherwise formed. The wall of the inner cylindrical portion is concave as shown with a curvature substantially similar to the curvature of the wall 36.

The disc 43 in this embodiment is also made of plastic and is centrally apertured as at 44. The disc is cylindrical similar to the disc 25 shown in FIG. 3.

In operation, the stem is inserted into the head 30 and snapped into position, the dimensions of the upper portion 37 being such that the stem snap engages within the aperture 34 and is held frictionally therein. In this action, the concavedly curved cylindrical portion 39 of the stem head snaps over the convexedly curved wall 36 of the head 30 so that the stem is held firmly within the head 30 and extending concentrically therefrom. Once the disc and head are assembled, the disc may be engaged on the stem after the fabric has been inserted and will hold the fabric over the button in a manner similar to that previously described and illustrated in FIG. 5.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A button construction for dressmaking, upholstering use and the like, adapted to be covered with flexible material such as fabrics and the like; comprising in combination a button head and a attaching stem, and apertured locking disc engaging over said attaching stem, means to fixedly engage said locking disc with said head internally thereof, to hold in place, the associated flexible material covering said head and means to connect said stem and said head together, said last mentioned means comprising a stepped aperture formed centrally through said head, said aperture including an outer portion and an inner portion, the diameter of said outer portion being larger than the diameter of said inner portion, the wall defining said inner portion being convexedly curved, said stem including an upper stepped cylindrical portion having an upper portion and a lower portion, the diameter of said upper portion being larger than the diameter of said lower portion, the wall of said lower portion being concavedly curved, said stepped stem snap engaging into the stepped aperture within said head with the convexedly curved wall of said head engaging within the concavedly curved wall of said stem.

2. The construction according to claim 1 in which said attaching stem includes a closed loop on the distal end thereof.

3. The construction according to claim 1 in which said stem extends perpendicularly from the center of the underside of said button head.

4. The construction according to claim 2 in which said stem extends perpendicularly from the center of the underside of said button head.

5. The construction according to claim 1 in which said head includes a central portion and a peripheral wall extending from the outer edge of said central portion, said means to fixedly engage said disc within said head including an inturned lip formed on the free edge of said peripheral wall, the peripheral edge of said apertured locking disc snap engaging inwardly and over said lip, the associated material being held between said disc and said lip and extending over the head to enclose same.

6. The construction according to claim 2 in which said head includes a central portion and a peripheral wall extending from the outer edge of said central portion, said means to fixedly engage said disc within said head including an inturned lip formed on the free edge of said peripheral wall, the peripheral edge of said apertured locking disc snap engaging inwardly and over said lip, the associated material being held between said disc and said lip and extending over the head to enclose same.

7. The construction according to claim 3 in which said head includes a central portion and a peripheral wall extending from the outer edge of said central portion, said means to fixedly engage said disc within said head including an inturned lip formed on the free edge of said peripheral wall, the peripheral edge of said apertured locking disc snap engaging inwardly and over said lip, the associated material being held between said disc and said lip and extending over the head to enclose same.

8. The construction according to claim 4 in which said head includes a central portion and a peripheral wall extending from the outer edge of said central portion, said means to fixedly engage said disc within said head including an inturned lip formed on the free edge of said peripheral wall, the peripheral edge of said apertured locking disc snap engaging inwardly and over said lip, the associated material being held between said disc and said lip and extending over the head to enclose same.

9. The construction according to claims 5, 6 or 7 in which said inturned lip extends inwardly and then curls over and outwardly to form a rolled lip around said free edge, said disc being resilient.

* * * * *